US011910881B2

(12) United States Patent
Fyfe et al.

(10) Patent No.: US 11,910,881 B2
(45) Date of Patent: Feb. 27, 2024

(54) ZIPCORD CLOSURE MECHANISM FOR AN ARTICLE OF FOOTWEAR

(71) Applicant: NIKE, Inc., Beaverton, OR (US)

(72) Inventors: Althea R. Fyfe, Portland, OR (US); Doug D. Wilken, Hillsboro, OR (US)

(73) Assignee: NIKE, Inc., Beaverton, OR (US)

( * ) Notice: Subject to any disclaimer, the term of this patent is extended or adjusted under 35 U.S.C. 154(b) by 287 days.

(21) Appl. No.: 17/220,486

(22) Filed: Apr. 1, 2021

(65) Prior Publication Data

US 2021/0307456 A1 Oct. 7, 2021

Related U.S. Application Data

(60) Provisional application No. 63/017,411, filed on Apr. 29, 2020, provisional application No. 63/003,529, filed on Apr. 1, 2020.

(51) Int. Cl.

| | |
|---|---|
| ***A43C 1/00*** | (2006.01) |
| ***A43C 11/20*** | (2006.01) |
| ***A43C 11/12*** | (2006.01) |
| ***A43C 1/06*** | (2006.01) |

(52) U.S. Cl.

CPC ..... *A43C 11/20* (2013.01); *A43C 1/06* (2013.01); *A43C 11/12* (2013.01)

(58) Field of Classification Search

CPC ..... A43C 11/20; A43C 1/06; A43C 11/12; A43C 11/00; A43C 7/00; Y10T 24/3703

See application file for complete search history.

(56) References Cited

U.S. PATENT DOCUMENTS

| | | | | |
|---|---|---|---|---|
| 1,678,273 A * | 7/1928 | Schutz | ..... | A43C 11/12 24/437 |
| 1,942,486 A | 1/1934 | Miller | | |
| 2,969,573 A * | 1/1961 | Forrester | ..... | A43C 11/12 24/438 |
| 2,978,774 A * | 4/1961 | Hawkins | ..... | A43C 11/12 24/438 |
| 2,987,835 A * | 6/1961 | Forrester | ..... | A43C 11/12 36/50.1 |
| 3,078,600 A * | 2/1963 | Roda | ..... | A43C 11/12 D2/978 |

(Continued)

FOREIGN PATENT DOCUMENTS

| | | |
|---|---|---|
| CN | 109862802 A | 6/2019 |
| CN | 110392535 A | 10/2019 |

(Continued)

*Primary Examiner* — Katharine G Kane
(74) *Attorney, Agent, or Firm* — Quinn IP Law

(57) ABSTRACT

A closure mechanism for an article of footwear is provided. The article of footwear having an upper comprising a lateral sidewall and a medial sidewall, a vamp, an ankle opening, a first tension member, a second tension member, and a slider. The first tension member being coupled to the lateral sidewall portion and the second tension member being coupled to the medial sidewall at each of a first end near the vamp, an intermediate point at the ankle opening, and a second end. The slider may be coupled to and movable along the tension members from a first position at the vamp to a second position at the ankle opening, such that moving the slider from the first position to the second position operatively reduces a maximum size of the ankle opening.

19 Claims, 10 Drawing Sheets

(56) References Cited

U.S. PATENT DOCUMENTS

| | | | | | |
|---|---|---|---|---|---|
| 3,122,810 | A * | 3/1964 | Lawrence | A43C 11/20 | D2/978 |
| 3,212,150 | A * | 10/1965 | Forrester | A43C 11/12 | 24/437 |
| 4,104,768 | A * | 8/1978 | Labecki | A43C 11/20 | 24/70 R |
| 4,142,307 | A * | 3/1979 | Martin | A43C 11/1486 | 36/118.2 |
| 4,631,840 | A * | 12/1986 | Gamm | A43C 11/12 | 36/51 |
| 4,780,936 | A * | 11/1988 | Brecher | A43C 11/20 | 24/712.2 |
| D361,426 | S | 8/1995 | Baker | | |
| 5,450,629 | A | 9/1995 | Gilstrap | | |
| 5,467,537 | A * | 11/1995 | Aveni | A43C 11/00 | 24/712.1 |
| 5,678,325 | A | 10/1997 | Davidowitz et al. | | |
| D402,795 | S | 12/1998 | Moll et al. | | |
| 5,884,419 | A | 3/1999 | Davidowitz et al. | | |
| D413,711 | S | 9/1999 | Hicks, Jr. | | |
| 6,237,252 | B1 | 5/2001 | Cook | | |
| 6,467,096 | B1 | 10/2002 | Coluccio | | |
| D475,842 | S | 6/2003 | Cook | | |
| 7,287,342 | B2 * | 10/2007 | Keen | A43C 1/00 | 36/50.1 |
| 7,320,189 | B2 | 1/2008 | Clark et al. | | |
| 7,347,012 | B2 | 3/2008 | Clark et al. | | |
| D581,143 | S | 11/2008 | Hubner | | |
| D662,304 | S | 6/2012 | Spring | | |
| D693,546 | S | 11/2013 | Chenciner | | |
| D696,844 | S | 1/2014 | Curtis | | |
| 8,695,233 | B2 | 4/2014 | Youngs | | |
| D738,073 | S | 9/2015 | Chenciner | | |
| D756,071 | S | 5/2016 | Onderick | | |
| D791,457 | S | 7/2017 | Membreno | | |
| 2002/0178618 | A1 * | 12/2002 | Pitts | A43B 23/047 | 36/11 |
| 2006/0000116 | A1 | 1/2006 | Brewer | | |
| 2007/0011910 | A1 * | 1/2007 | Keen | A43B 23/07 | 36/50.1 |
| 2011/0099843 | A1 | 5/2011 | Jung | | |
| 2014/0000074 | A1 * | 1/2014 | Guthner | A43C 7/00 | 24/712.9 |
| 2017/0245595 | A1 * | 8/2017 | Ramos | A43C 1/04 | |
| 2020/0077748 | A1 | 3/2020 | Dyer et al. | | |

FOREIGN PATENT DOCUMENTS

| | | | | |
|---|---|---|---|---|
| JP | 2014226332 | A | 12/2014 | |
| KR | 100807105 | B1 * | 2/2007 | A43B 11/00 |

* cited by examiner

ZIPCORD CLOSURE MECHANISM FOR AN ARTICLE OF FOOTWEAR

CROSS REFERENCE TO RELATED APPLICATIONS

This application claims the benefit of U.S. Provisional Application No. 63/003,529, filed Apr. 1, 2020 and U.S. Provisional Application No. 63/017,411, filed Apr. 29, 2020, each of which is hereby incorporated by reference in its entirety.

TECHNICAL FIELD

The present disclosure generally relates to a closure mechanism for an article of footwear.

BACKGROUND

Articles of footwear generally include two primary elements, namely an upper and a sole structure. The sole structure is configured to be located under a wearer's foot, to space the foot away from the ground and to further provide stability and cushioning. The sole structure may include an outsole, a midsole, and an insole. In applications wherein a midsole, outsole, and insole are each present, the midsole may provide support and cushioning, the outsole may provide improved traction with the ground, and the insole may provide increased comfort for the foot.

A footwear upper may be attached to the sole structure and at least partially surround an interior volume that receives the foot of a wearer. The upper is often formed from a plurality of material elements (e.g., textiles, polymer sheet layers, foam layers, leather, synthetic leather) that are stitched or adhesively bonded together to form the interior volume. More particularly, the upper may form a structure that extends over the instep and toe areas of the foot, along medial and lateral sides of the foot, and around a heel area of the foot. In many designs, the upper may also incorporate a closure system to adjust the fit of the footwear, as well as permitting entry and removal of the foot from the interior volume.

SUMMARY

In general, the article of footwear may comprise a sole structure and an upper fixedly attached to the sole structure. The upper may comprise a lateral sidewall portion and a medial sidewall portion cooperating to define an interior volume therebetween. The upper may further comprise a vamp, an ankle opening, and a heel counter portion, with the ankle opening being operative to allow a wearer to extend a foot into the interior volume. A throat opening may extend from the ankle opening toward the vamp and between the lateral sidewall portion and the medial sidewall portion.

The upper may further include a closure mechanism configured to selectively adjust a maximum size of the ankle opening. The closure mechanism may include a first tension member, a second tension member, and a slider.

The first tension member may have a first end, a second end, and a first tension member intermediate point. The first end may be coupled to the lateral sidewall portion at a first lateral attachment point, the first tension member intermediate point may be integrally coupled to the lateral sidewall portion at a second lateral attachment point, and the second end may be coupled to the lateral sidewall portion at a third lateral attachment point.

The second tension member may have a first end, a second end, and a second tension member intermediate point. The first end may be attached to the medial sidewall portion at a first medial attachment point, the intermediate point may be integrally coupled to the medial sidewall portion at a second medial attachment point, and the second end may be coupled to the medial sidewall portion at a third medial attachment point.

The slider may be coupled to and movable along each of the first tension member and the second tension member from a first position to a second position. In the first position, the slider is closer to the vamp than the ankle opening, and in the second position, the slider is closer to the ankle opening than the vamp, such that moving the slider from the first position to the second position operatively reduces a maximum size of the ankle opening.

DETAILED DESCRIPTION

Figure 1:
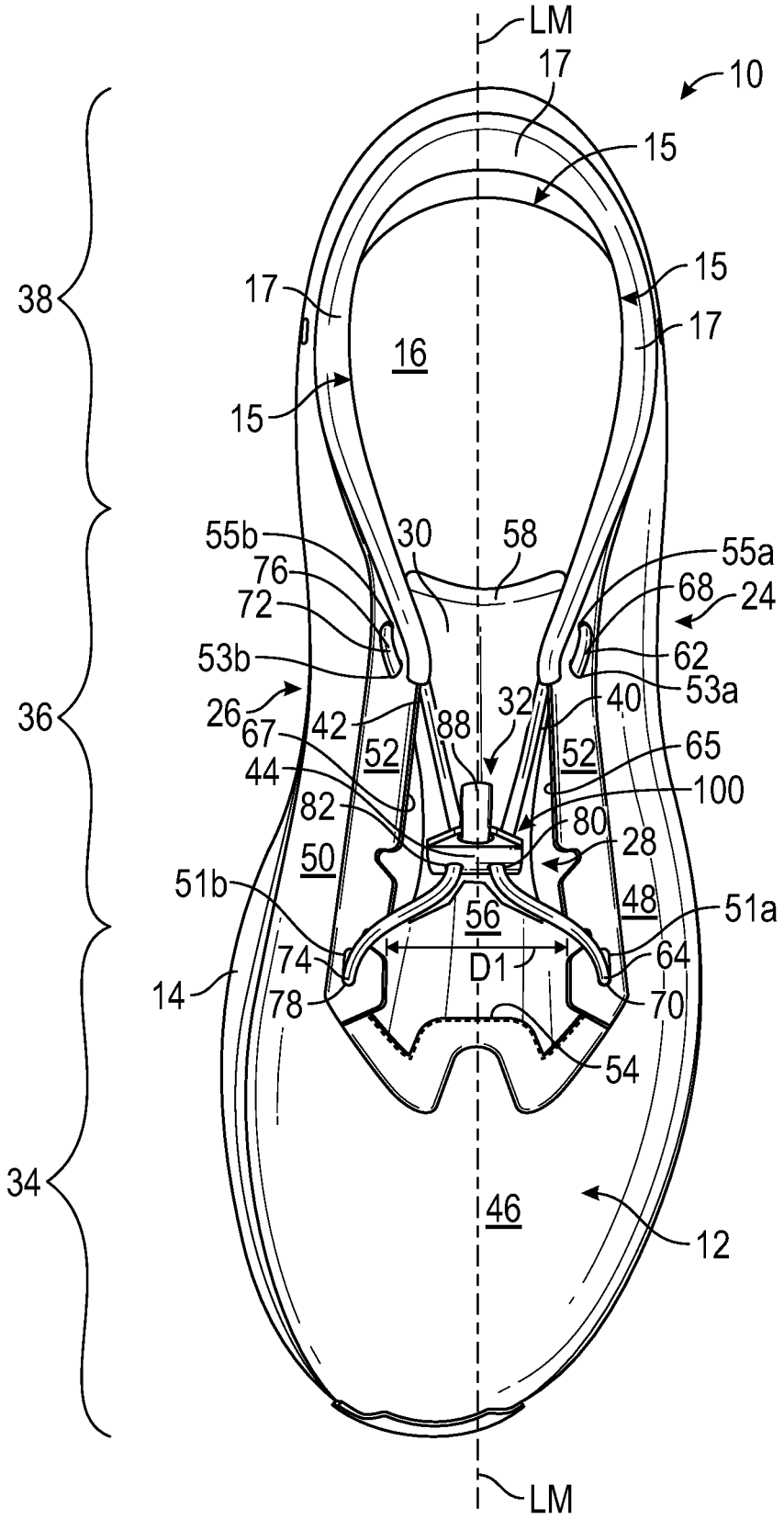
FIG. 1 is a schematic top perspective view of a first example athletic shoe having a closure mechanism comprising a first tension member, a second tension member, and a slider and, wherein the slider is in a first position.
Figure 2:
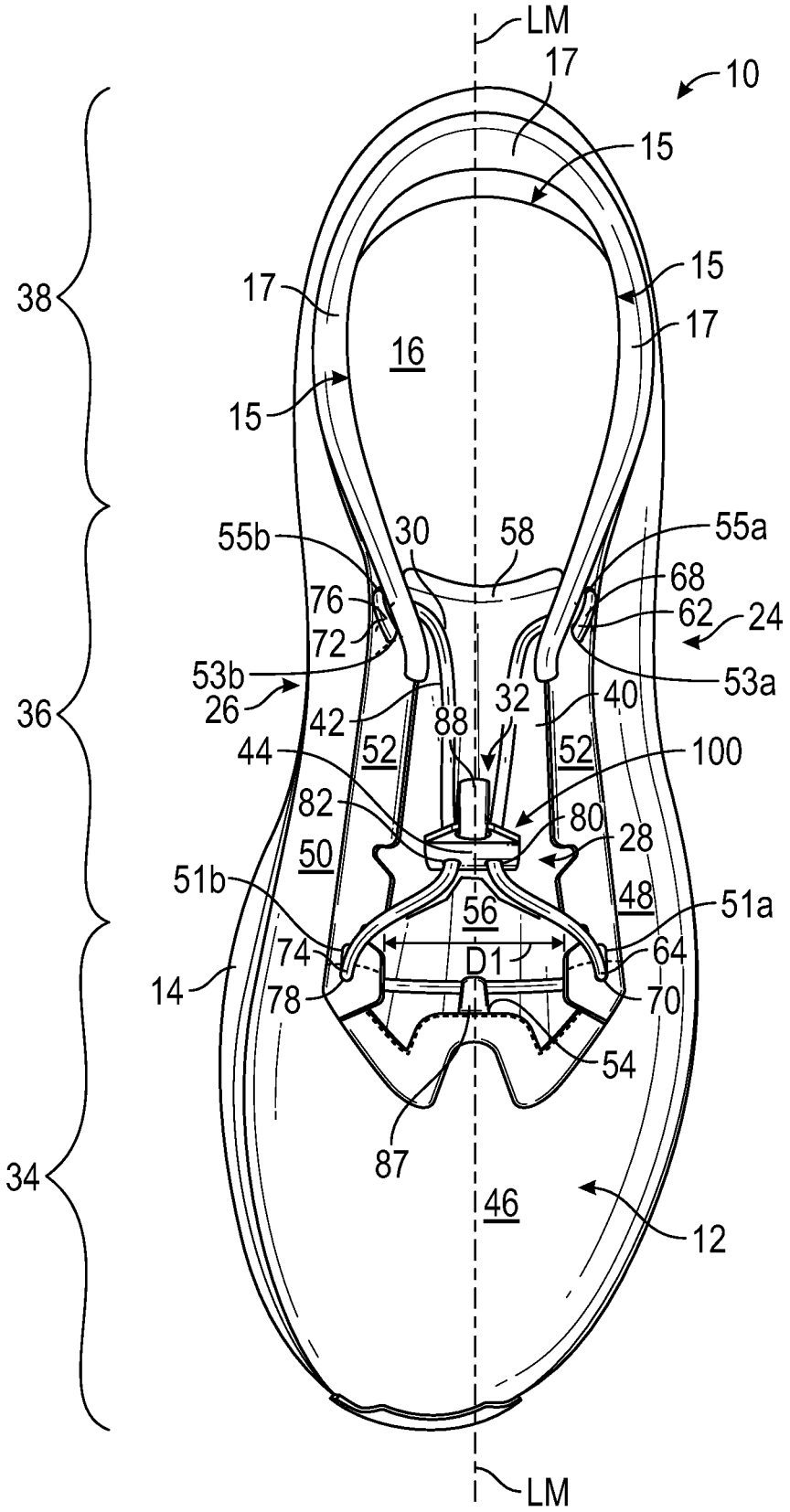
FIG. 2 is a schematic top perspective view of a second example athletic shoe having a closure mechanism comprising a first tension member, a second tension member, and a slider and, wherein the slider is in a first position.
Figure 3:
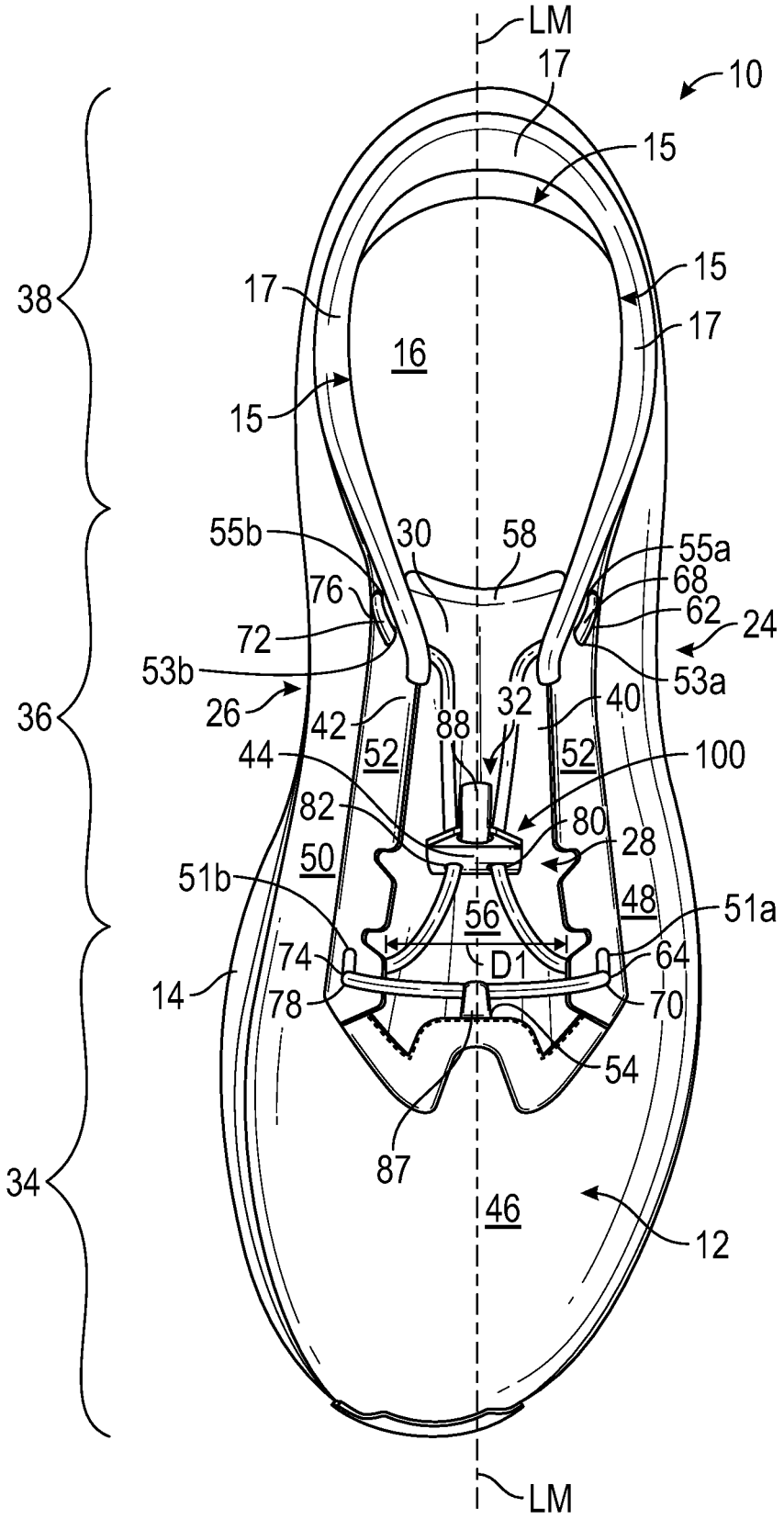
FIG. 3 is a schematic top perspective view of a third example athletic shoe having a closure mechanism comprising a first tension member, a second tension member, and a slider and, wherein the slider is in a first position.

While the present disclosure may be described with respect to specific applications or industries, those skilled in the art will recognize the broader applicability of the disclosure.

The terms "a", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Features shown in one figure may be combined with, substituted for, or modified by, features shown in any of the figures. Unless stated otherwise, no features, elements, or limitations are mutually exclusive of any other features, elements, or limitations. Furthermore, no features, elements, or limitations are absolutely required for operation. Any specific configurations shown in the figures are illustrative only and the specific configurations shown are not limiting of the claims or the description.

For consistency and convenience, directional adjectives are employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims. Any numerical designations, such as "first" or "second" are illustrative only and are not intended to limit the scope of the disclosure in any way.

The term "longitudinal", as used throughout this detailed description and in the claims, refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse", as used throughout this detailed description and in the claims, refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical", as used throughout this detailed description and in the claims, refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

In addition, the term "proximal" refers to a direction that is nearer a center of a footwear component or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

To assist and clarify the subsequent description of various embodiments, various terms are defined herein. Unless otherwise indicated, the following definitions apply throughout this specification (including the claims). An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

The following discussion and accompanying figures disclose various footwear configurations. Although the article of footwear 10 is depicted as athletic footwear configured for sports, such as sneakers, in the associated Figures, concepts associated with the configurations and methods may be applied to various other types of athletic footwear articles, such as a hiking boots and shoes, soccer shoes, football shoes, running shoes, cross-training shoes, rugby shoes, basketball shoes, etc. However, the article of footwear 10 is not limited to sneakers or other sports shoes. In some embodiments, the disclosed provisions may be configured for use with various kinds of non-sports-related footwear, including but not limited to, boots, leisure shoes, dress shoes, work shoes, sandals, slippers, or any other category of footwear, which may also incorporate concepts discussed herein.

In a general sense, the present disclosure provides a closure mechanism 32 for a wearable article having a lateral sidewall portion 24 and a medial sidewall portion 26 that is separated from the lateral sidewall portion 24. The lateral sidewall portion 24 and the medial sidewall portion 26 cooperate to define an interior volume 16 therebetween, accessible via an opening 15.

More particularly, the wearable article may be an article of footwear 10. In such an example, the opening is an ankle opening 15. The upper 12 for the article of footwear 10 defines the interior volume or cavity 16, which is adapted to receive a foot of a wearer. The upper 12 further comprises a closure mechanism 32 having a first tension member 40, a second tension member 42, and a slider 44. The slider 44 is coupled to and movable along at least a portion of each of the first tension member 40 and the second tension member 42 from a first position 100 to a second position 200, such that moving the slider 44 from the first position 100 to the second position 200 operatively reduces a maximum size of the ankle opening 15 and imparts tension in each of a lateral sidewall portion 24 and a medial sidewall portion 26 of the upper 12, when a foot is within the interior volume 16.

Referring to the drawings, wherein like reference numerals refer to like components throughout the several views, an article of footwear 10 is provided. As shown in FIGS. 1-9B, the article of footwear 10 comprises an upper 12 fixedly attached to a sole structure 14.

The upper 12 is a portion of the article of footwear 10 that defines an interior volume or cavity 16 adapted to receive a foot of a wearer. For the purpose of consistency and clarity, the "interior" of the article of footwear 10 refers to space that is occupied by a wearer's foot when the article of footwear 10 is worn. The "inner side" of the upper 12 or other shoe element refers to the face of that panel or element that is (or will be) oriented toward the interior in a completed article of footwear 10. The "outer side" or "exterior" of an element refers to the face of that element that is (or will be) oriented away from the interior in a completed article of footwear 10.

As indicated in FIGS. 1-8B, the article of footwear 10 may be divided into a forefoot region 34, a midfoot region 36, and a heel region 38, which are likewise the forefoot region 34, the midfoot region 36, and the heel region 38, of the sole structure 14 and the upper 12, respectively. The forefoot region 34 generally includes portions of the article of footwear 10 corresponding with the toes and the joints connecting the metatarsals with the phalanges. The midfoot region 36 generally includes portions of the article of footwear 10 corresponding with the arch area and instep of the foot. The heel region 38 corresponds with rear portions of the foot, including the calcaneus bone. The forefoot region 34, the midfoot region 36, and the heel region 38 are not intended to demarcate precise areas of the footwear 10, but are instead intended to represent general areas of the footwear 10 to aid in the following discussion.

The upper 12 of the article of footwear 10 further has a lateral sidewall portion 24 (FIGS. 1-6, 7A, 8A, and 9A-9B) and a medial sidewall portion 26 (FIGS. 1-6, 7B, 8B, and 9A-9B). The lateral sidewall portion 24 and medial sidewall portion 26 extend through each of the forefoot region 34, the midfoot region 36, and the heel region 38, and correspond with opposite sides of the article of footwear 10, each falling on an opposite side of a longitudinal midline LM of the article of footwear 10, partially indicated in FIGS. 1-6. The medial sidewall portion 26 is thus considered opposite to the lateral sidewall portion 24.

The sole structure 14 may include provisions for attenuating ground reaction forces (i.e., cushioning and stabilizing the foot during vertical and horizontal loading). In addition, sole structure 14 may be configured to provide traction, impart stability, and control or limit various foot motions, such as pronation, supination, or other motions. For example, the disclosed concepts may be applicable to footwear configured for use on any of a variety of surfaces, including indoor surfaces or outdoor surfaces. In some embodiments, the sole structure 14 may be configured to provide traction and stability on hard indoor surfaces (such as hardwood); soft, natural turf surfaces; or on hard, artificial turf surfaces.

In different embodiments, the sole structure 14 may include different components, which may, individually or collectively, provide an article with a number of attributes, such as support, rigidity, flexibility, stability, cushioning, comfort, reduced weight, or other attributes. For example, the sole structure 14 may include a midsole, an outsole, and a cushioning layer and/or insole. The compressible polymer element of the sole structure 14 attenuates ground reaction forces (i.e., provides cushioning) when compressed between the foot and the ground during walking, running, or other ambulatory activities, and may be formed from a compressible polymer element, such as a thermoset or a thermoplastic, for example, a cross-linked thermosetting plastic, a cross-linked thermosetting resin, or a crosslinked thermosetting elastomer (e.g., rubber), a polyurethane foam, ethylvinylacetate (EVA) foam, an ionomeric polymer foam, or the like. In further configurations, the midsole may incorporate fluid-filled chambers, plates, moderators, or other elements that further attenuate forces, enhance stability, or influence the motions of the foot.

The midsole may be a single, one-piece midsole, or could be multiple components integrated as a unit. In some embodiments, the midsole may be integrated with the outsole as a unisole. The outsole may be one-piece, or may be several outsole components, and may be formed from a wear-resistant rubber material that may be textured to impart traction and/or may include traction elements such as cleats secured to the midsole.

When the foot is positioned within the foot-receiving interior cavity 16 of the article of footwear 10, the foot is supported on a foot-facing surface of the midsole. Optionally, the foot-facing surface of the midsole may be covered by a strobel secured to a lower region of the upper 12. Also, optionally, an insole may rest on the strobel or directly on the sole structure 14 in embodiments without a strobel, in which case the foot is supported by both the sole structure 14 and the insole.

It may be appreciated, however, that the sole structure 14 is not limited to incorporating traditional sole components and may incorporate various different kinds of elements arranged at the outermost, innermost, and intermediate 'layers', or locations, of the sole. Thus, the sole structure 14 can include an outer sole member or element, which may or may not coincide with a conventional 'outsole'. Likewise, the sole structure 14 may include an inner sole member or element, which may or may not be an 'insole'. Further, the sole structure 14 can include any number of intermediate and/or middle sole members or elements, which may or may not be a 'midsole'.

The sole structure 14 may be permanently and/or fixedly attached to one or more portions of the upper 12 (for example, with adhesive, stitching, welding, or other suitable techniques) at a bite line 95 and may have a configuration that extends between the upper 12 and the ground. For purposes of this disclosure, the term "permanently attached" shall refer to two components joined in a manner such that the components may not be readily separated (for example, without destroying one or both of the components). In addition, two components may be "permanently attached" by virtue of being integrally formed, for example, through a molding process.

In general, the upper 12 includes provisions to reduce any tendency of the foot to be pulled away from the sole structure 14 during use. In some embodiments, the upper 12 may be a conventional upper defining and at least partially surrounding an interior volume or cavity 16 for receiving a foot of a wearer. The upper 12 may be formed of a variety of materials, such as leather, textiles, polymers, cotton, foam, composites, etc. The upper 12 may be comprised of a material that has elasticity, breathability, or both in order to aid with foot insertion and comfort. For example, the upper 12 may be a polymeric material or textile material capable of providing elasticity, and may be of a braided construction, a knitted (e.g., warp-knitted) construction, or a woven construction.

In other embodiments, the upper 12 may be configured to provide a 'tension fit' about a wearer's foot. As used herein, the term tension fit refers to a fit that ensures the upper is pulled against the foot at all times including on a lower side where the sole of the foot contacts a bottom portion of the upper 12. In some cases, a tension fit upper may be configured so that when no foot is present within the interior cavity 16, the interior cavity 16 has a volume that is smaller than the volume after a foot has been inserted. In other words, the upper 12 may be configured to stretch or expand as a foot is inserted. Such a configuration may provide an upper 12 that 'stays with' the foot, and especially the sole of the foot, at all times during any activities (e.g., running, jumping, walking, etc.). A tension fit may or may not require stretching in the upper 12. In some cases, the upper 12 can be configured to stretch significantly when a foot is inserted. In other cases, however, the upper 12 may simply fit the foot very snugly without significant expansion.

The upper 12 defines the lateral sidewall portion 24 and medial sidewall portion 26, and the lateral sidewall portion 24 and the medial sidewall portion 26 cooperate to define the interior volume 16 therebetween. The upper 12 may further define a vamp 46 that extends into the forefoot region 34 and the midfoot region 36 on each of the lateral sidewall portion 24 and the medial sidewall portion 26 of the upper 12. The upper 12 may further define a lateral quarter 48 and a medial quarter 50, which abut the vamp 46 and extend into the midfoot region 36 of the respective lateral sidewall portion 24 and medial sidewall portion 26 of the upper 12. The upper 12 may still further define a heel counter 19 which is positioned in the heel region 38 between the bite line 95 and an ankle collar portion 17.

The ankle collar portion 17 of the article of footwear 10 defines and borders an ankle opening 15. The ankle opening 15 is operative to allow a wearer to extend a foot into the interior volume 16 defined by the upper 12. When a foot is present within the interior volume 16, the ankle collar portion 17 extends circumferentially around the wearer's ankle and may provide additional lateral support. The ankle opening 15 may have a maximum size, which may be reduced via the closure mechanism 32.

A throat opening 28 may be disposed between the lateral sidewall portion 24 and the medial sidewall portion 26 and extend from the ankle opening 15 toward the vamp 46 and between the lateral sidewall portion 24 and the medial sidewall portion 26. The throat opening 28 may be an extension of the ankle opening 15 and may further permit access of a wearer's foot into the interior cavity 16 of the upper 12. The throat opening 28 may be bordered or surrounded by an eye stay reinforcement 52.

As best illustrated in FIGS. 1-6, The eye stay reinforcement 52 may define at least two first eyelet openings 51*a*, 51*b* positioned at or near the vamp 46 and at least two pairs of eyelet openings, e.g., at least two second eyelet openings 53*a*, 53*b* and at least two third eyelet openings 55*b* at or near the ankle opening 15. More particularly, a first eyelet opening 51*a* near the vamp 46 on the lateral sidewall portion 24, a second eyelet opening 53*a* at the ankle collar portion 17 on the lateral sidewall portion 24, and a third eyelet opening 55*a* at the ankle collar portion 17 on the lateral sidewall portion 24. The third eyelet opening 55*a* being disposed between the second eyelet opening 53*a* and the ankle opening 15, and said another way, the second eyelet opening 53*a* is disposed between the third eyelet opening 55*a* and the throat portion 28. Still further, a first eyelet opening 51*b* near the vamp 46 on the medial sidewall portion 26, a second eyelet opening 53*b* at the ankle collar portion 17 on the medial sidewall portion 26, and a third eyelet opening 55*b* at the ankle collar portion 17 on the medial sidewall portion 26. The third eyelet opening 55*b* being disposed between the second eyelet opening 53*b* and the ankle opening 15, and said another way, the second eyelet opening 53*b* is disposed between the third eyelet opening 55*b* and the throat portion 28.

A closure mechanism 32 may be positioned over and/or across the throat opening 28, such as laces or the like. The closure mechanism 32 may selectively couple the lateral sidewall portion 24 and the medial sidewall portion 26, while providing an ability to adjust the girth of the upper 12 and the maximum size of the ankle opening 15. The closure mechanism 32 may generally include a unitary closure panel or tongue portion 30, a plurality of tension members 40, 42, and a slider 44.

Figure 7A:
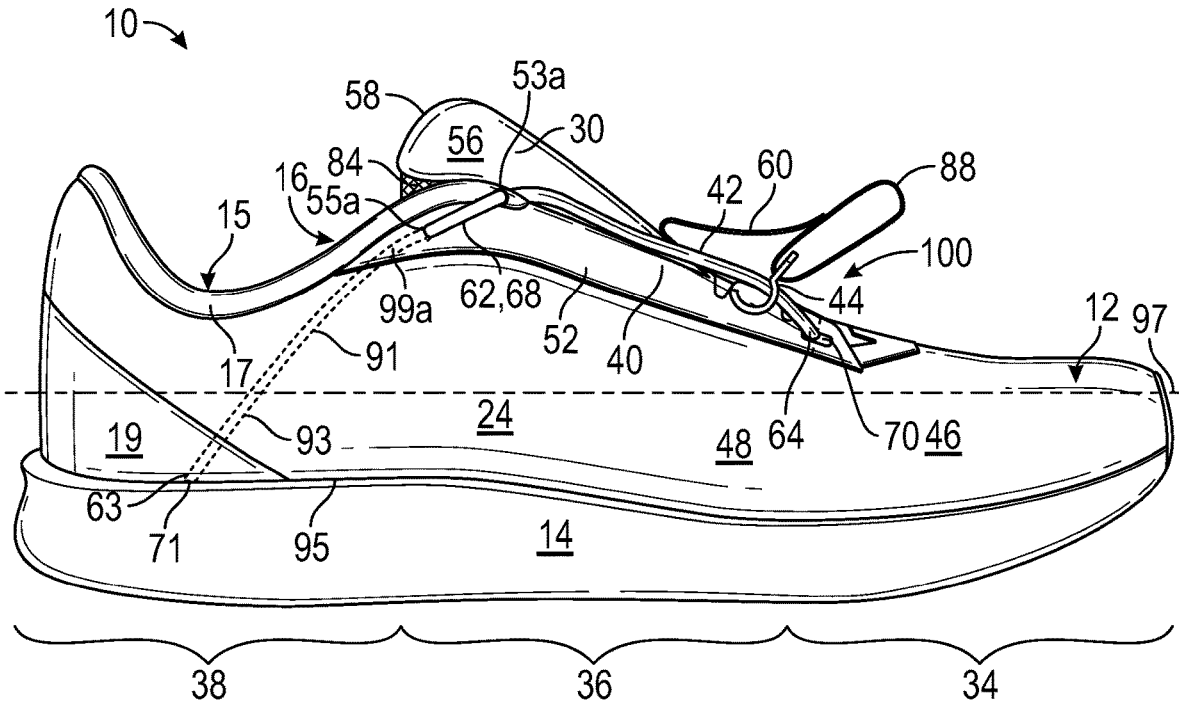
FIG. 7A is a schematic lateral side view of a first embodiment of the example athletic shoe of FIGS. 3 and 6, wherein the slider is in the first position.
Figure 7B:
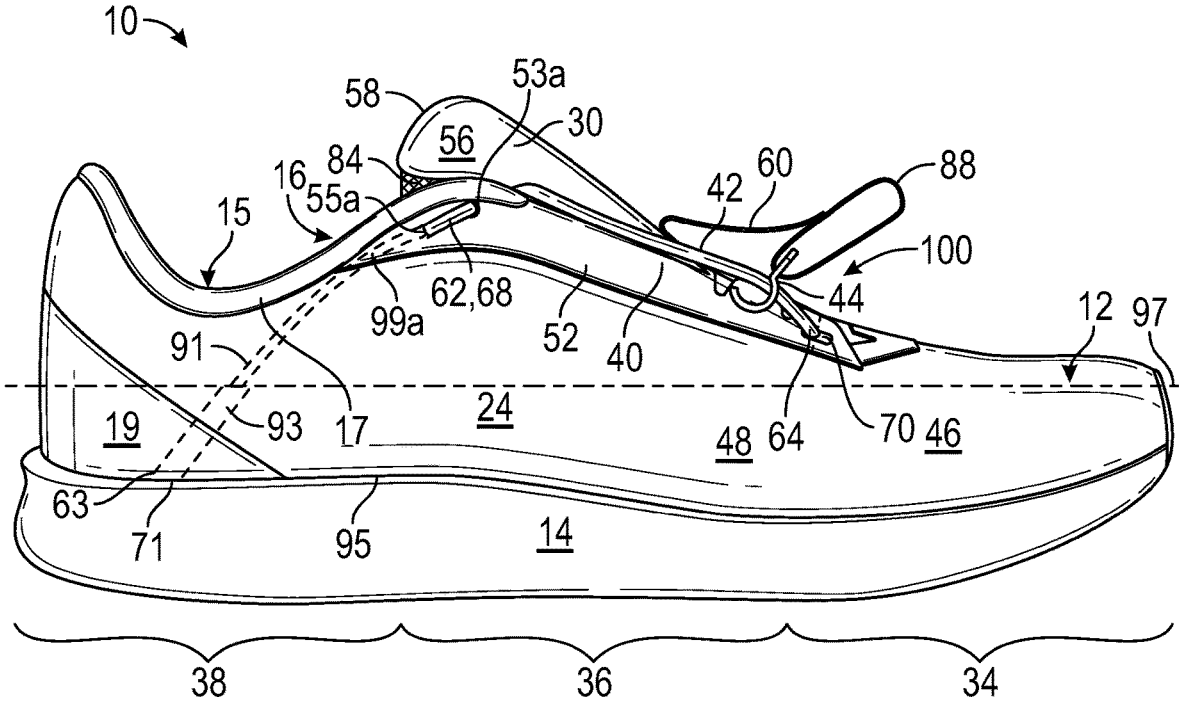
FIG. 7B is a schematic lateral side view of a second embodiment of the example athletic shoe of FIGS. 3 and 6, wherein the slider is in the first position.
Figure 9A:
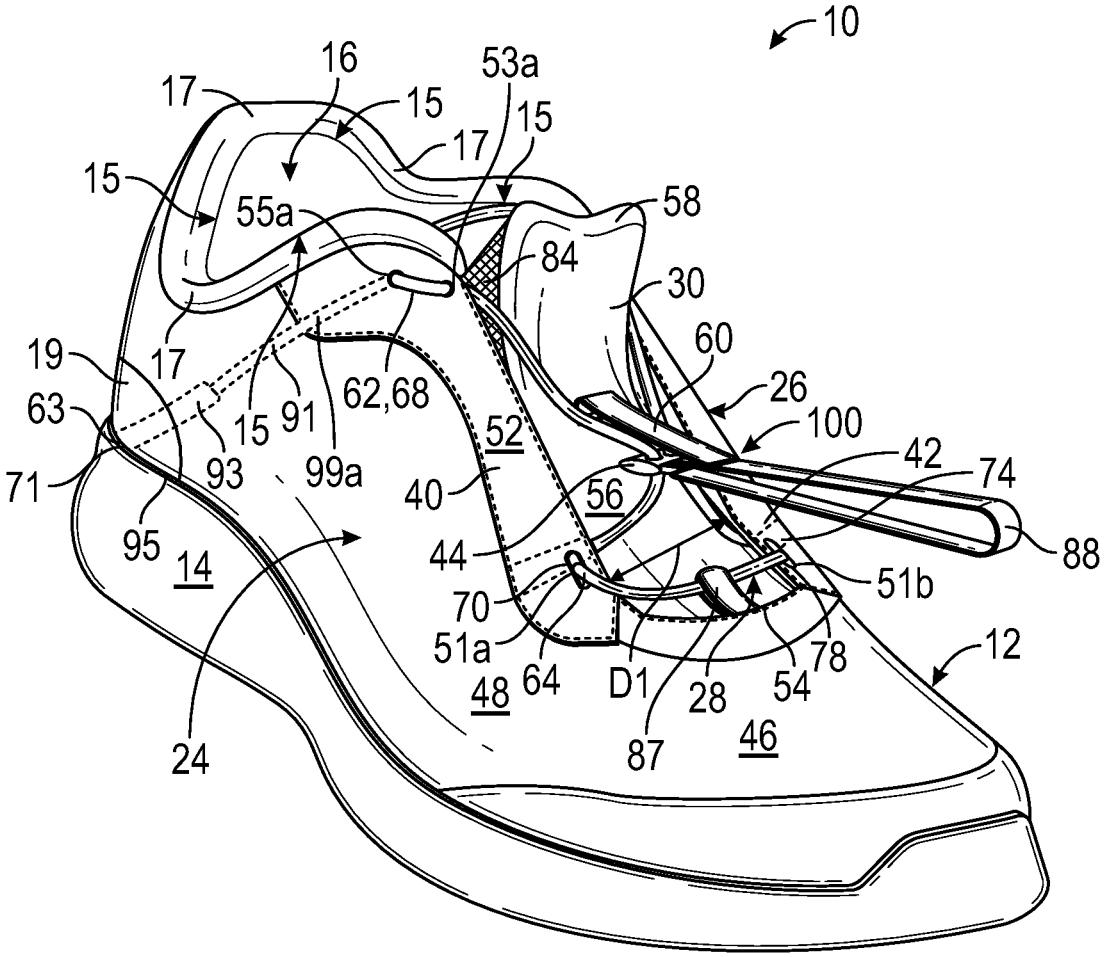
FIG. 9A is a schematic perspective view of the second embodiment of the example athletic shoe of FIGS. 7B and 8B, wherein the slider is in the first position.

The tongue portion 30 may extend over the instep region of the foot. The tongue portion 30 may be integrated with or separately secured to the vamp 46. Further the tongue portion may have a first tongue portion 54 attached to the vamp 46 and a tongue body 56 extending from the first tongue portion 54 between the lateral sidewall portion 24 and the medial sidewall portion 26. The tongue body 56 may further define a tongue distal edge 58. As shown in FIGS. 7A, 7B, and 9A, a tongue attachment feature 60 may be coupled to and extend from the tongue body 56.

The closure mechanism 32 may further comprise a first tension member 40 and a second tension member 42. The first tension member 40 and the second tension member 42 may be formed of textile or fabric material, elastomeric material, polymeric materials, or the like and may be embodied as laces, cords, or the like. In one example, the tension members 40, 42 may comprise a fully non-elastomeric material, for example, a strong cord-like, non-elastomeric core with a plush exterior layer. In another example, the tension members 40, 42 may comprise a fully elastomeric material. In yet another example, the tension members 40, 42 may comprise a mixture of elastomeric materials and non-elastomeric materials.

Figure 4:
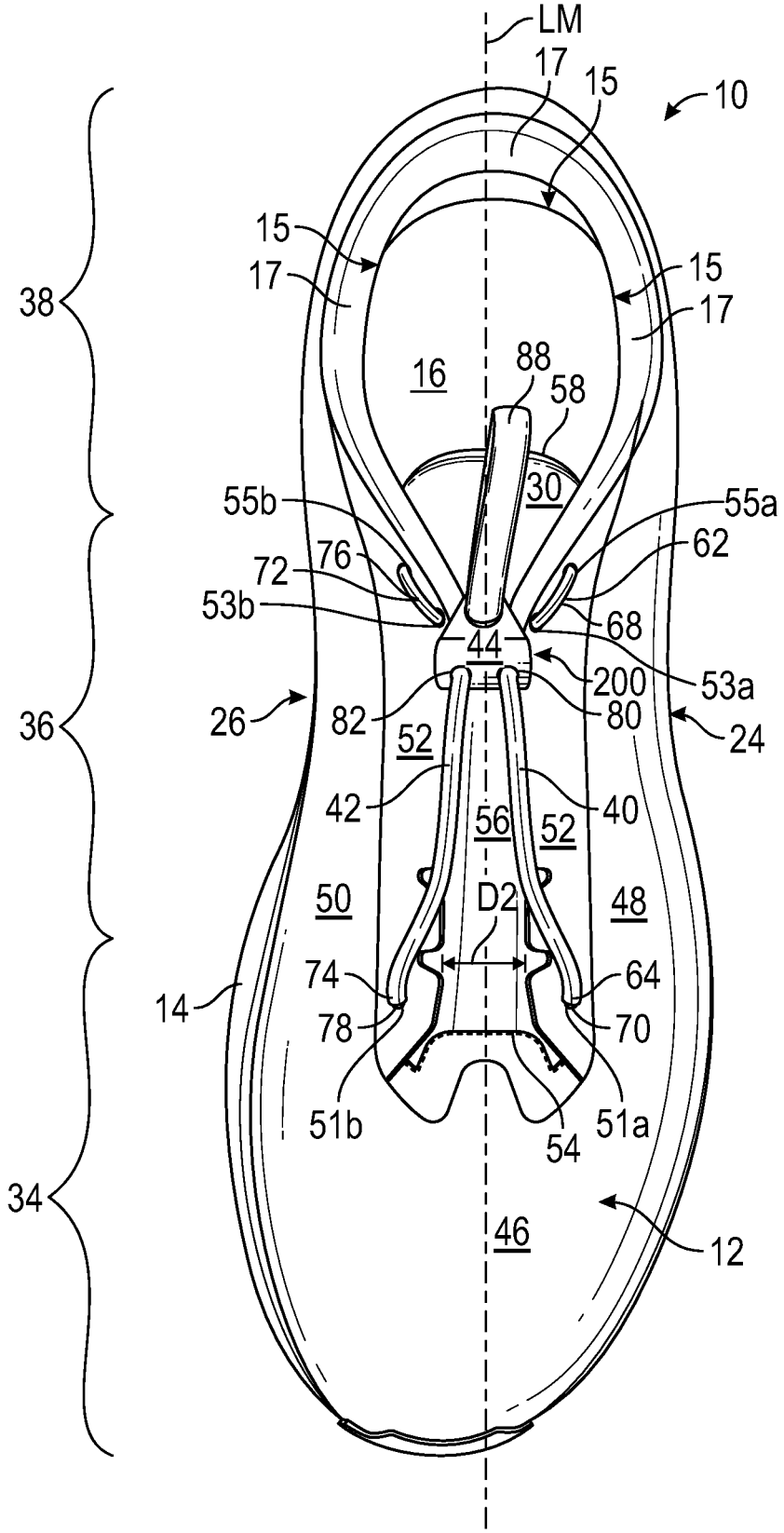
FIG. 4 is a schematic top perspective view of the example athletic shoe of FIG. 1, wherein the slider is in the second position.
Figure 5:
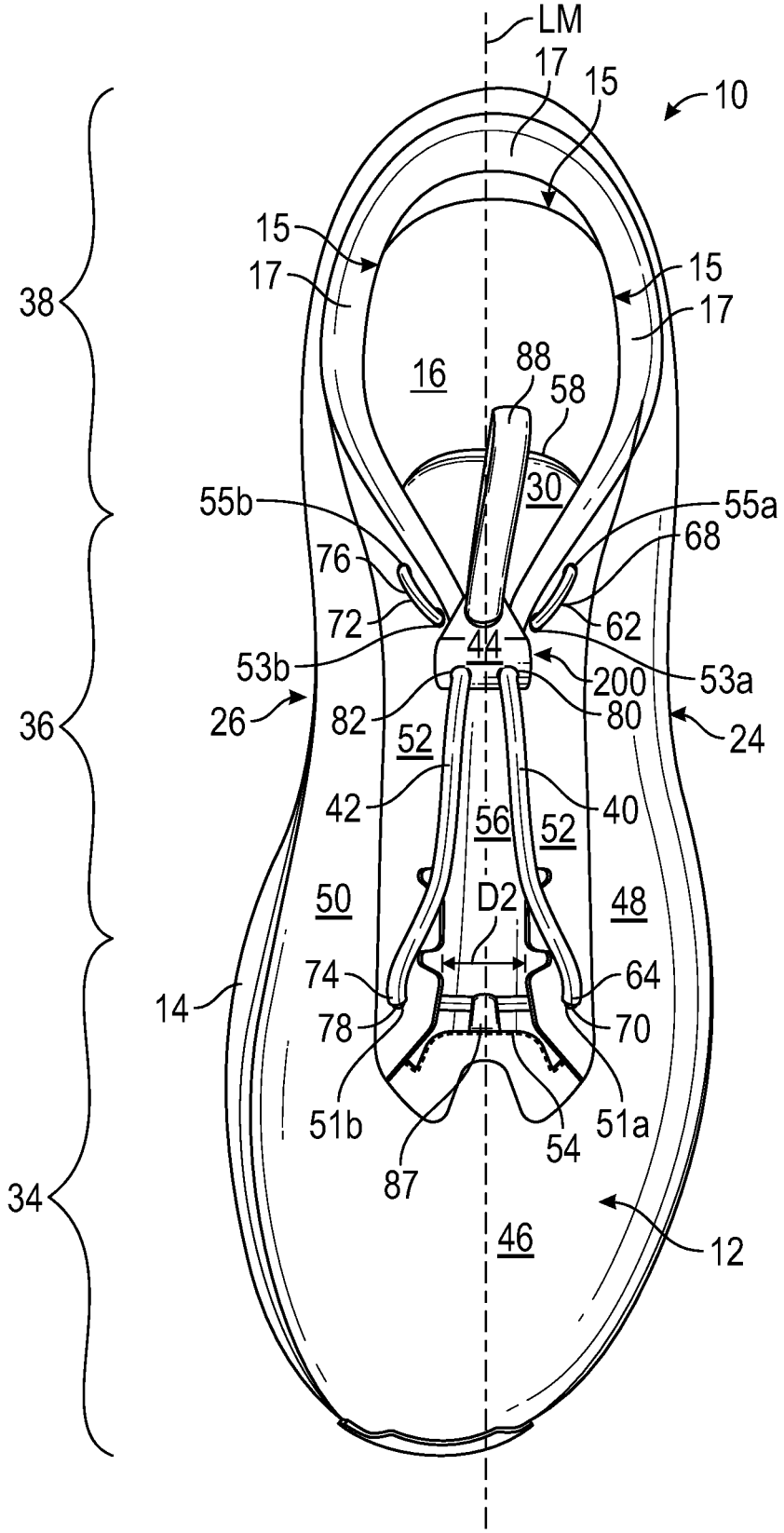
FIG. 5 is a schematic top perspective view of the example athletic shoe of FIG. 2, wherein the slider is in the second position.
Figure 6:
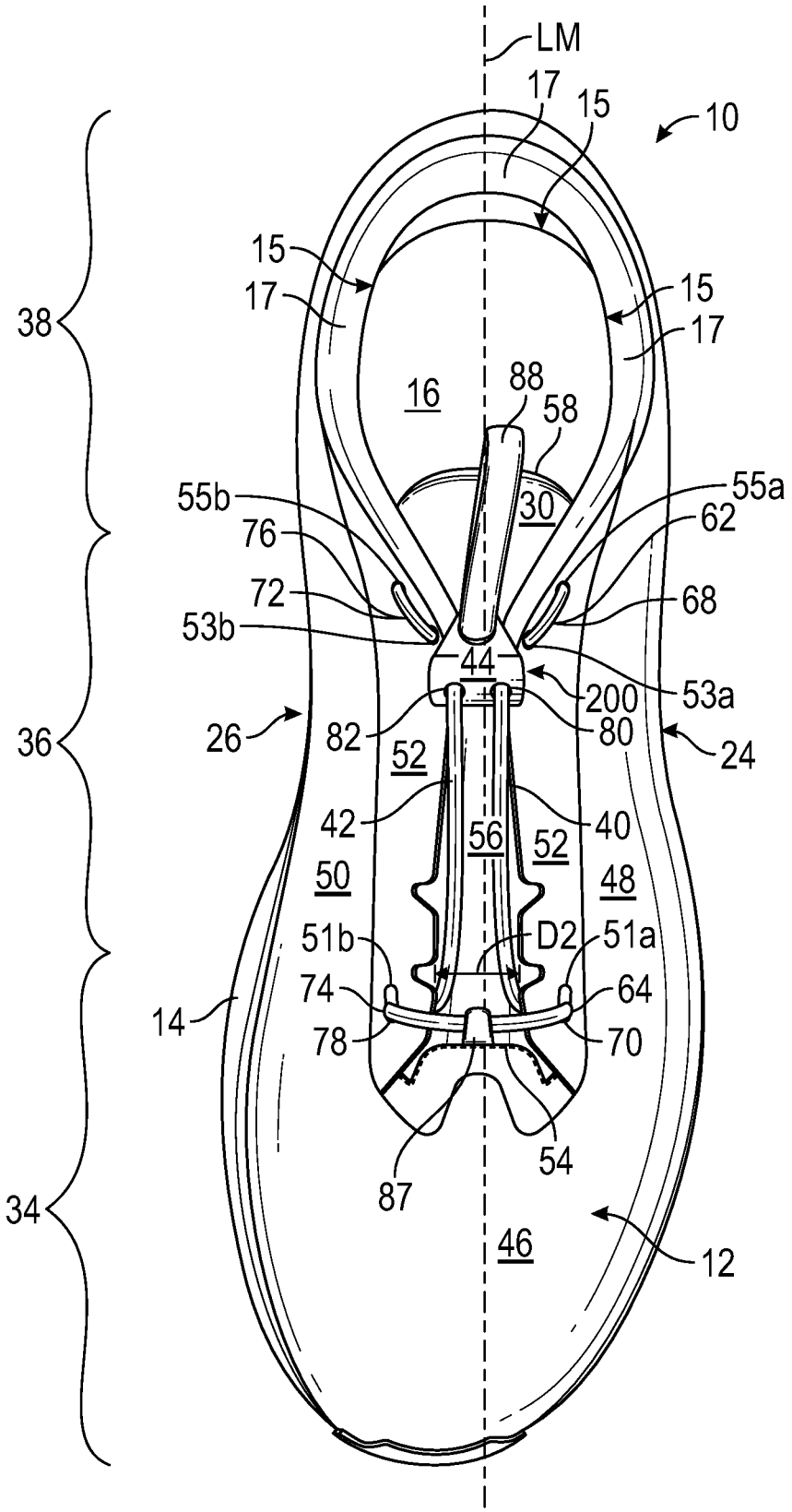
FIG. 6 is a schematic top perspective view of the example athletic shoe of FIG. 3, wherein the slider is in the second position.

In some examples, as shown in FIGS. 1 and 4, the first tension member 40 and the second tension member 42 may be independent tension members 40, 42. In such examples, the first tension member 40 and the second tension member 42 are independent tension members and are each non-intersecting with the longitudinal midline LM, and are further non-intersecting with each other. Said another way, the first tension member 40 is non-intersecting with each of the second tension member 42 and the longitudinal midline LM and the second tension member 42 is non-intersecting with each of the first tension member 40 and the longitudinal midline LM.

In other examples, as shown in FIGS. 2-3 and 5-9B, the first tension member 40 may be integrally coupled with the second tension member 42, or said another way, the first tension member 40 and second tension member 42 may comprise one unitary tension member. In the examples shown in FIGS. 2-3 and 5-9B, the first tension member 40 and the second tension member 42 may be integrally coupled tension members that form a non-intersecting arrangement.

In each of the examples shown in FIGS. 1-9B, the first tension member 40 may be coupled to the lateral sidewall portion 24 at the vamp 46 and extend along a length of the throat opening 28 from the vamp 46 to the ankle opening 15. As shown in FIG. 1, the first tension member 40 extends exterior to the upper 12 along the throat opening 28 from the first tension member first end 64, then extends under an edge 65 of the lateral sidewall portion 24 at the throat opening 28 to an inner side of the lateral sidewall portion 24, and then extends through the lateral sidewall portion 24 from the inner side of the lateral sidewall portion 24 to an exterior side of the lateral sidewall portion 24 before the first tension member intermediate point 62. The edge 65 of the lateral sidewall portion 24 extends along and defines the throat opening 28. The throat opening 28 extends forward from the ankle opening between the edge 65 of the lateral sidewall portion 24 and an edge 67 of the medial sidewall portion 26. In one example, the first tension member 40 may extend from the first lateral attachment point 70, positioned in the eye stay reinforcement 52 at the vamp 46, and terminally attach to the lateral sidewall portion 24 at the ankle opening 15, or continue downward from the ankle opening 15 to attach to the upper 12 on the lateral sidewall portion 24 at one of a midway point between the ankle opening 15 and the bite line 95, or further continue downward to attach to the upper 12 at the bite line 95 proximate the heel counter 19.

The first tension member 40 may have a first tension member first end 64, a first tension member second end 63, and a first tension member intermediate point 62. The first tension member 40 may have a first slider length defined from the first end 64 to the first tension member intermediate point 62. The first tension member first end 64 may be coupled to the lateral sidewall portion 24 at a first lateral attachment point 70. The first tension member intermediate point 62 may be integrally coupled to the lateral sidewall portion 24 at a second lateral attachment point 68 via eyelet openings 53*a* and 55*a*.

In an example wherein the first tension member 40 terminally attaches to the lateral sidewall portion 24 at the ankle opening 15, the first tension member second end 63 may be attached to the lateral sidewall portion 24 at or proximate to the third eyelet opening 55*a*. In another example, wherein the first tension member 40 continues downward from the ankle opening to attach to the upper 12 on the lateral side 24 at the bite line 95, the first tension member intermediate point 62 is disposed between the second eyelet opening 53*a* and the third eyelet opening 55*a*. The first tension member second end 63 may be coupled to the upper 12 at a third lateral attachment point 71. In this way, the first lateral attachment point 70 is positioned in the eye stay reinforcement 52 at the vamp 46, the second lateral attachment point 68 is positioned in the ankle collar portion 17 at the ankle opening 15, and the third lateral attachment point 71 is positioned at the bite line 95 proximate the heel counter 19.

Analogously, in each of the examples shown in FIGS. 1-9B, the second tension member 42 may be coupled to the medial sidewall portion 26 at the vamp 46 and extend along a length of the throat opening 28 from the vamp 46 to the ankle opening 15. As shown in FIG. 1, the second tension member 42 extends exterior to the upper 12 along the throat opening 28 from the second tension member first end 74, then extends under the edge 67 of the medial sidewall portion 26 at the throat opening 28 to an inner side of the medial sidewall portion 26, and then extends through the medial sidewall portion 26 from the inner side of the medial sidewall portion 26 to an exterior side of the medial sidewall portion 26 before the second tension member intermediate point 72. The edge 67 of the medial sidewall portion 26 extends along and defines the throat opening 28. In one example, the second tension member 42 may extend from the first medial attachment point 78, positioned in the eye stay reinforcement 52 at the vamp 46, and terminally attach to the medial sidewall portion 26 at the ankle opening 15, or continue downward from the ankle opening 15 to attach to the upper 12 on the medial sidewall portion 26 at one of a midway point between the ankle opening 15 and the bite line 95, or further continue downward to attach to the upper 12 at the bite line 95 proximate the heel counter 19.

The second tension member 42 may have a second tension member first end 74, a second tension member second end 73, and a second tension member intermediate point 72. The second tension member 42 may have a second slider length defined from the first end 74 to the second intermediate point 72. The second tension member first end 74 may be attached to the medial sidewall portion 26 at a first medial attachment point 78. The second tension member intermediate point 72 may be integrally coupled to the medial sidewall portion 26 at a second medial attachment point 76 via eyelet openings 53*b* and 55*b*.

In an example wherein the second tension member 42 terminally attaches to the medial sidewall portion 26 at the ankle opening 15, the second tension member second end 73 may be attached at or proximate to the third eyelet opening 55*b*. In another example, wherein the second tension member 42 continues downward from the ankle opening 15 to attach to the upper 12 on the medial side 26 at the bite line 95, the second intermediate point 72 is disposed between the second eyelet opening 53*a* and the third eyelet opening 55*a*. The second tension member second end 73 may be coupled to the upper 12 at a third medial attachment point 85. The first medial attachment point 78 is positioned in the eye stay reinforcement 52 at the vamp 46, the second medial attachment point 76 is positioned in the ankle collar portion 17 at the ankle opening 15, and the third medial attachment point 85 is positioned at the bite line 95 proximate the heel counter 19.

In the examples illustrated in FIGS. 1 and 4, the first tension member 40 may be attached or anchored to the lateral sidewall portion 24 at the first lateral attachment point 70 positioned at the vamp 46 and the second tension member 42 may be attached or anchored to the medial sidewall portion 26 at the first medial attachment point 78 positioned at the vamp 46.

In the examples illustrated in FIGS. 2-3 and 5-9B, the first tension member first end 64 may be coupled to the upper 12, such that it is threaded through and received by a first eyelet opening 51*a* at the first lateral attachment point 70, which is positioned in the eye stay reinforcement 52 at the vamp 46. The first tension member first end 64 may extend across the throat portion 28 near the vamp 46 where it is integral to and/or integrally coupled with the second tension member first end 74. In such an example, the second tension member first end 74 may be coupled to the upper 12, such that it is threaded through and received by a first eyelet opening 51*b* at the first medial attachment point 78, which is positioned in the eye stay reinforcement 52 at the vamp 46. The second tension member first end 74 may extend across the throat opening 28 near the vamp 46 where it is integral to and/or integrally coupled with the first tension member first end 64. Said another way, the first tension member 40 and second tension member 42 may comprise one unitary tension member.

In the examples illustrated in FIGS. 2-3 and 5-9B the unitary tension member may extend across the throat opening 28 from the lateral sidewall portion 24 to the medial sidewall portion 26. The unitary tension member may be received by and extend through one or more webbing loops or lace guides 87 that are generally positioned in the throat opening 28 between lateral sidewall portion 24 and the medial sidewall portion 26. More particularly, the one or more webbing loops or lace guides 87 may be positioned in the throat opening 28 and secured or anchored to the vamp 46 at the first tongue portion 54 between the lateral sidewall portion 24 and the medial sidewall portion 26.

In one example, additional webbing loops, straps, or lace guides may be further positioned along the lateral sidewall portion 24 and medial sidewall portion 26 of the throat opening 28 between the first lateral attachment point 70 and second lateral attachment point 68 on the lateral side 24 and between the first medial attachment point 78 and the second medial attachment point 76 on the medial side 26. Such additional lace guides, loops, or straps may be configured to receive the respective first tension member 40 on the lateral side 24 and second tension member 42 on the medial side 26 respectively, such that the first tension member 40 extends therethrough and is coupled to the upper 12 between the first lateral attachment point 70 and second lateral attachment point 68 on the lateral side 24 and the second tension member 42 extend therethrough and is coupled to the upper 12 between the first medial attachment point 78 and the second medial attachment point 76 on the medial side 26. By adding further lace guides or straps in the midfoot region 36 along the throat portion 28 and routing the respective tension members therethrough 40, 42 tensioning of the tension members 40, 42 may be improved, such that the tension members 40, 42 impart further tensile stress to the lateral sidewall portion 24 and the medial sidewall portion 26 of the upper 12 and thereby reduce the girth of the upper 12 about the foot of a wearer.

As illustrated in FIGS. 1-6 and 9A-9B, the first tension member 40 extends along the throat portion 28 from the first tension member first end 64 coupled to the lateral sidewall portion 24 at the vamp 46 via the first eyelet opening 51*a*, to the first intermediate point 62 at the ankle collar portion 17. At the first intermediate point 62, the first tension member 40 is routed interior to the lateral sidewall portion 24 and enters and is received by the second eyelet opening 53*a* at an interior surface of the lateral sidewall portion 24. The first tension member 40 is received by the second eyelet opening 53*a* and extends from the interior surface of the lateral sidewall portion 24 to an exterior surface of the lateral sidewall portion 24. The first tension member 40 is then routed exterior to the lateral sidewall portion 24 on the ankle collar 17 from the second eyelet opening 53*a* to the third eyelet opening 55*a*, wherein the first tension member 40 enters and is received by the third eyelet opening 55*a* at the exterior surface of the lateral sidewall portion 24 and passes therethrough to the interior surface of the lateral sidewall portion 24 and into the void space 16.

Likewise, the second tension member 42 extends along the throat portion 28 from the second tension member first end 74 coupled to the medial sidewall portion 26 at the vamp 46 via the first eyelet opening 51*b*, to the second intermediate point 72 at the ankle collar portion 17. At the second tension member intermediate point 72, the second tension member 42 is routed interior to the medial sidewall portion 26 and enters and is received by the second eyelet opening 53*b* at the interior surface of the medial sidewall portion 26. The second tension member 42 is received by the second eyelet opening 53*b* and extends from the interior surface of the medial sidewall portion 26 to an exterior surface of the medial sidewall portion 26. The second tension member 42 is then routed exterior to the medial sidewall portion 26 on the ankle collar 17 from the second eyelet opening 53*b* to the third eyelet opening 55*b*, wherein the second tension member 42 enters and is received by the third eyelet opening 55*b* at the exterior surface of the medial sidewall portion 26 and passes through to the interior surface of the medial sidewall portion 26 and into the void space 16.

In some embodiments, referring now to FIGS. 7A-7B, 8A-8B, and 9A-9B, the first tension member 40 may extend just past the third eyelet opening 55*a* to the first tension member second end 63, which is attached and/or anchored to the lateral sidewall portion 24 of the upper 12 proximate the third eyelet opening 55*a* in the midfoot region 36 at intermediate attachment point 99*a*. In such embodiments, the second tension member 40 may extend just past the third eyelet opening 55*b* to the second tension member second end 73, which is attached and/or anchored to the medial sidewall portion 26 of the upper 12 proximate the third eyelet opening 55*b* in the midfoot region 36 at intermediate attachment point 99*b*.

In other embodiments, again referring to FIGS. 7A-7B, 8A-8B, and 9A-9B, the first tension member 40 may extend from the third eyelet opening 55*a* to the first tension member second end 63, which is attached and/or anchored to the upper 12 at the third lateral attachment point 71 positioned at the bite line 95 proximate the heel counter 19. As such, the first tension member 40 may extend in the void space 16 along the interior surface of the lateral sidewall portion 24 from the third eyelet opening 55*a* to the first tension member second end 63. In such an example, the first tension member 40 may be visible within the interior volume 16 along the interior surface of the lateral sidewall portion 24. Alternatively, in embodiments wherein the lateral sidewall portion comprises a plurality of layers, including at least an outer layer and an inner layer, the first tension member 40 may extend along an interior surface of the outer layer of lateral sidewall portion 24 and along an exterior surface of the inner layer of the lateral sidewall portion 24. Said another way, the first tension member 40 may extend between the inner layer and the outer layer of the lateral sidewall portion 24 from the third eyelet opening 55*a* to the second end 63 at the third lateral attachment point 71. In such an example, wherein the first tension member 40 extends between the inner layer and the outer layer of the lateral sidewall portion 24, the first tension member 40 is not visible within the interior volume 16 along the interior surface of the lateral sidewall portion 24.

In one example, the first tension member second end 63 may be anchored to the bite line 95 proximate the heel counter 19 on the lateral side of the upper 12 at the third lateral attachment point 71. In another example, the first tension member second end 63 may be anchored to the lateral sidewall portion 24 at the bite line 95 proximate the heel counter 19.

Again, referring to 7A-7B, 8A-8B, and 9A-9B, the second tension member 42 may extend from the third eyelet opening 55*b* to the second tension member second end 73, which is attached and/or anchored to the upper 12 at the third medial attachment point 85 positioned at the bite line 95 proximate the heel counter 19. As such, the second tension member 42 may extend in the void space 16 along the interior surface of the medial sidewall portion 26 from the third eyelet opening 55*b* to the second end 73 at the third medial attachment point 85. In such an example, the second tension member 42 may be visible within the interior volume 16 along the interior surface of the medial sidewall portion 26. Alternatively, in embodiments wherein the medial sidewall portion 26 comprises a plurality of layers, including at least an outer layer and an inner layer, the second tension member 42 may extend along an interior surface of the outer layer of medial sidewall portion 26 and along an exterior surface of the inner layer of the medial sidewall portion 26. Said another way, the second tension member 42 may extend between the inner layer and the outer layer of the medial sidewall portion 26 from the third eyelet opening 55*b* to the second end 73 at the third medial attachment point 85. In such an example, wherein the second tension member 42 extends between the inner layer and the outer layer of the medial sidewall portion 26, the second tension member 42 is not visible within the interior volume 16 along the interior surface of the medial sidewall portion 26.

In one example, the second end 73 of second tension member 42 may be anchored to the bite line 95 proximate the heel counter 19 on the medial side 26 of the upper 12 at the third medial attachment point 85. In another example, the second end 73 of the second tension member 42 may be anchored to the medial sidewall portion 26 at the bite line 95 proximate the heel counter 19.

As further illustrated in FIGS. 7A-7B, 8A-8B, and 9A-9B, the first tension member 40 may comprise a first tension member first portion 91 and a first tension member second portion 93 between the first tension member intermediate point 62 and the first tension member second end 63. Likewise, the second tension member 42 may comprise a second tension member first portion 91 and a second tension member second portion 93 between the second tension member intermediate point 72 and the second tension member second end 73.

The first portion 91 of the respective first tension member 40 and the second tension member 42, may be defined as the portion of the respective tension member 40, 42 that is between the third eyelet opening 55*a*, 55*b* in the ankle collar portion 17 and a predefined datum 97. The second portion 93 may be defined as the portion of the respective tension member 40, 42 that is between the predetermined datum 97 and the bite line 95. The predefined datum 97 may be positioned between the ankle opening 15 and the bite line 95, in that the predefined datum 97 is below the ankle opening 15 and above the bite line 95. In one example, the predefined datum is about 30.0 millimeters above the bite line 95, e.g., upward from the sole structure 14 toward the ankle opening 15, the throat portion 28, and the vamp 46.

Figure 8A:
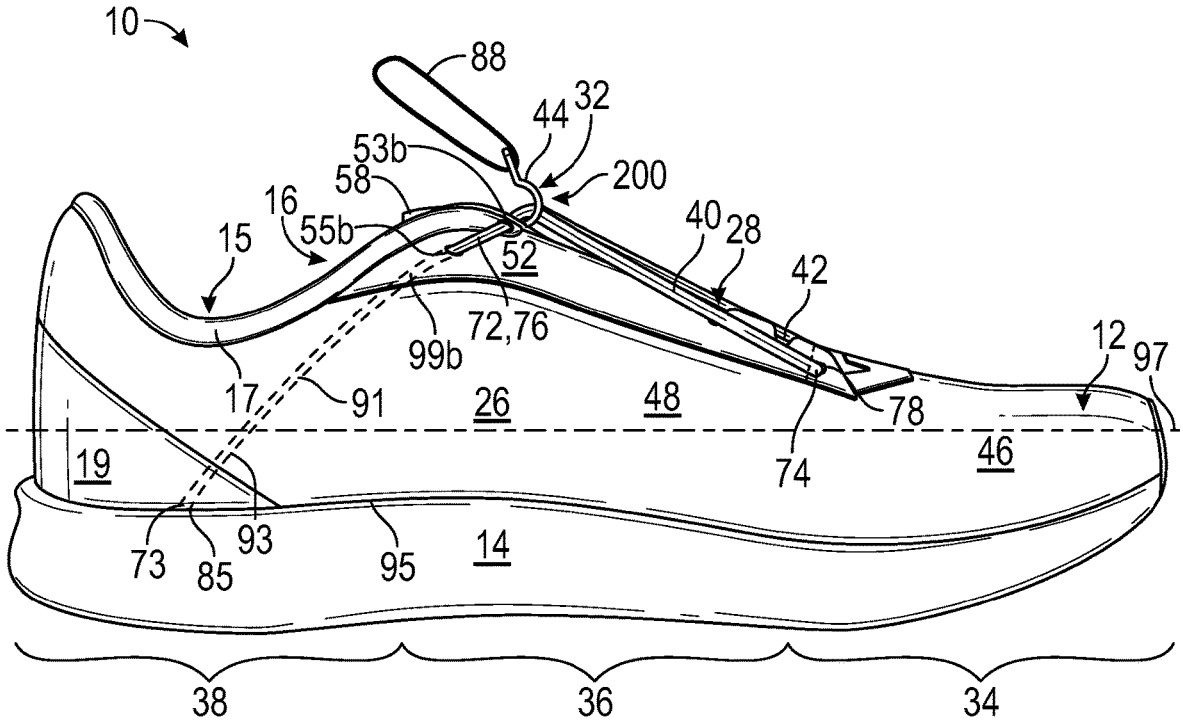
FIG. 8A is a schematic medial side view of the first embodiment of the example athletic shoe of FIGS. 3 and 6, wherein the slider is in a second position.
Figure 9B:
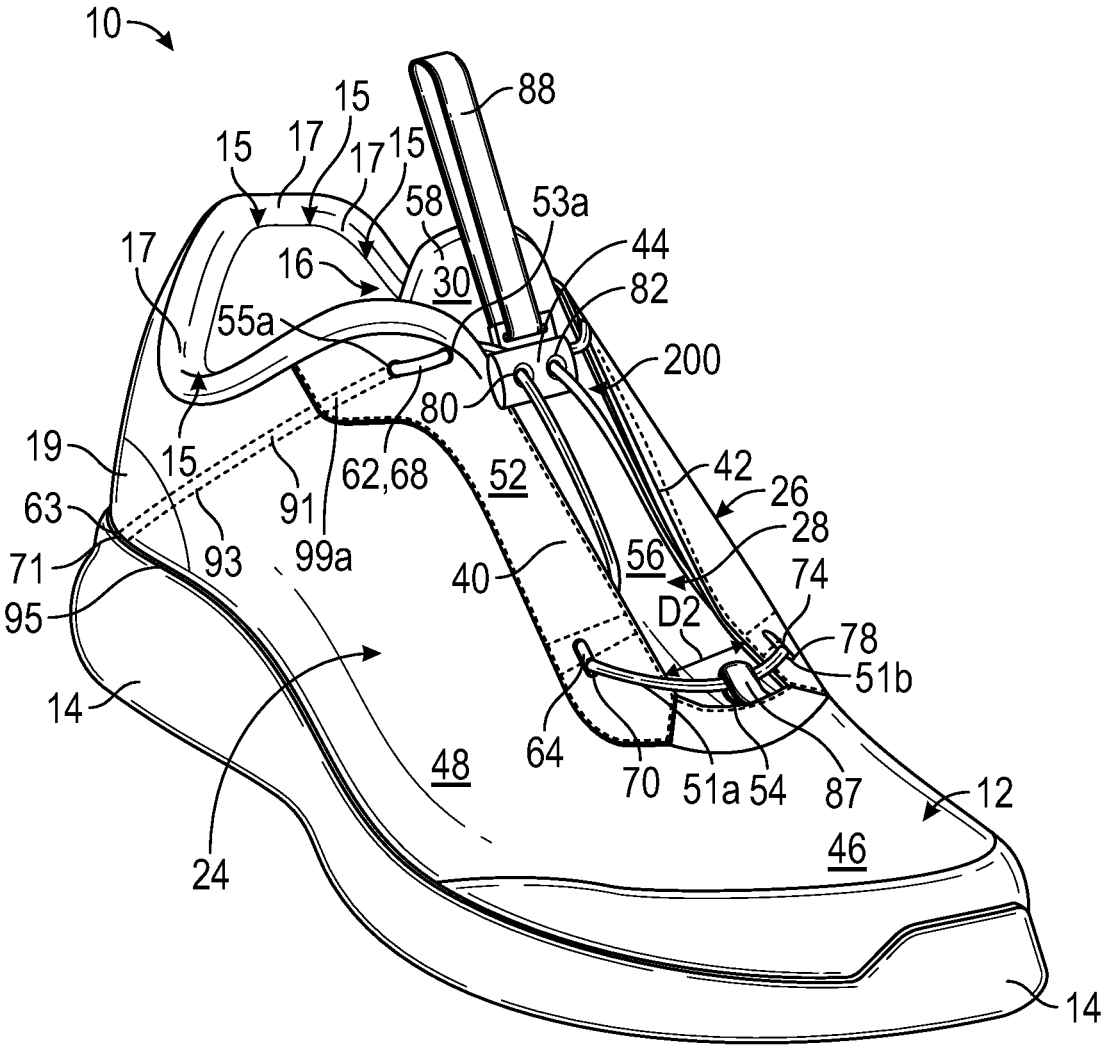
FIG. 9B is a schematic perspective view of the first embodiment of the example athletic shoe of FIGS. 7A and 8A, wherein the slider is in the second position.

In one example, shown in FIGS. 7A, 8A, and 9B the first portion 91 and the second portion 93 of the tension members 40, 42 comprise a non-elastomeric, cord-like material having a plush exterior layer. In this example, the material composition of the first portion 91 and the second portion 93 are substantially the same. Further, the material composition of an entirety of the respective tension members 40, 42 is substantially the same from the first end 62, 74 to the second end 63, 73.

Figure 8B:
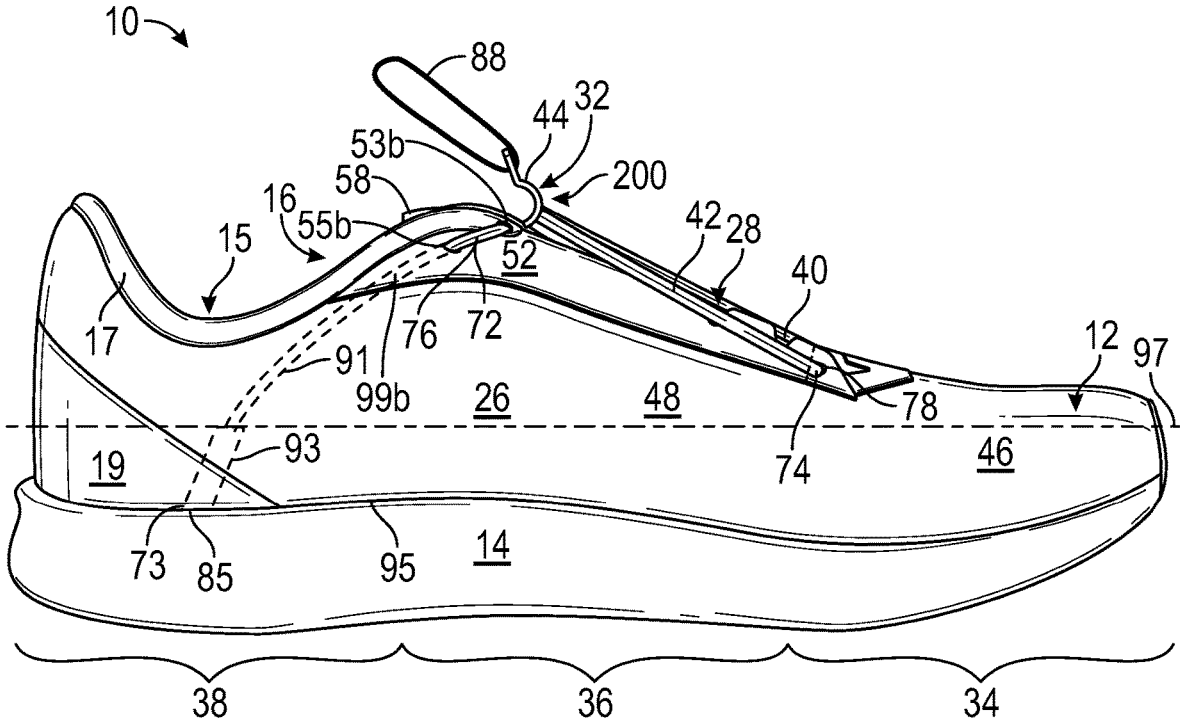
FIG. 8B is a schematic medial side view of a second embodiment of the example athletic shoe of FIGS. 3 and 6, wherein the slider is in the second position.

In another example, shown in FIGS. 7B, 8B, and 9A, the first portion 91 may comprise a non-elastomeric material, and more particularly, a non-elastomeric, cord-like material having a plush exterior layer, which is substantially the same as the material composition of the respective tension member from the respective first end 62, 74 to the intermediate point 62, 72. In such an example, the second portion 93 may comprise an elastomeric material. The elastomeric material of the second portion 93 may comprise an elastomeric cord of the same size and dimensions of the non-elastomeric cord of the first portion 91. Alternatively, the elastomeric material of the second portion 93 may be a piece or patch of elastomeric material, for example, an elastomeric textile strap. In examples wherein the second portion 93 comprises an elastomeric material, a maximum size of the ankle opening 15 may be further increased over designs with fully non-elastomeric tension members 40, 42 in order to allow additional ease of access for a foot of the wearer.

A slider 44 may be coupled to each of the first tension member 40 and the second tension member 42, such that the first tension member 40 and the second tension member 42 are operatively coupled to one another via the slider 44. The slider 44 may comprise a Thermoplastic Polyurethane (TPU) material and have thickness of from about 1.0 millimeters to about 3.0 millimeters. The slider 44 may be a spring-loaded slider 44, wherein an internal spring causes the slider to mechanically engage the respective tension members 40, 42 or a non-spring-loaded slider 44 that is frictionally engaged with the respective tension members 40, 42.

The first tension member 40 and the second tension member 42 may be received by or otherwise coupled to the slider 44 in a variety of ways. In one example embodiment, FIGS. 1-9B, the slider 44 may define a first aperture 80, such that the first aperture 80 receives the first tension member 40 therein. In such an example embodiment, the slider 44 may further define a second aperture 82, such that the second aperture 82 receives the second tension member 42 therein. The first aperture 80 and the second aperture 82 may be from about 2.5 millimeters in diameter to about 3.5 millimeters in diameter.

In this way, in some embodiments, wherein the slider 44 is a non-spring-loaded slider, the diameter of the respective first aperture 80 and the second aperture 82 may be reduced to the lower end of the range, e.g., about 2.5 millimeters such that the respective aperture 80, 82 impinges on the plush exterior of the respective tension member 40, 42 creating a frictional mechanical engagement that holds the slider 44 in place thereon. Further, in some examples, the tension members 40, 42 may have a frictional coating applied to the exterior thereof to create the requisite frictional mechanical engagement to facilitate locking and/or gripping of the slider 44 on the respective tension members 40, 42. In other embodiments, wherein the slider 44 is a spring-loaded slider, the diameter of the respective first aperture 80 and the second aperture 82 may be enlarged to the higher end of the range, e.g., about 3.5 millimeters, such that the aperture 80, 82 does not impinge the respective tension member 40, 42 but allows the internal spring to position relative components to mechanically engage and disengage.

In one example embodiment, as shown in FIGS. 7A-7B and 9A, the slider 44 may be further coupled to the tongue body 56. In such examples, the slider 44 may be coupled to the tongue body 56 via a tongue attachment feature 60 or tongue tether. The tongue tether 60 may be permanently fixed to or removably fixed to the slider 44. The tongue tether 60 may be formed from a textile, leather, polymeric, or similar material, and may further be defined as a strip of material or a loop of material operatively attached to the slider 44.

The slider 44 may be moveable along the first slider length of the first tension member 40 and the second slider length of the second tension member 42. The first slider length is defined from the first tension member first end 64 to the first tension member intermediate point 62 and may be substantially equal to the second slider length defined from the second tension member first end 74 to the second tension member intermediate point 72. Said another way, the length the slider 44 may travel along the first tension member 40 and the second tension member 42 may be substantially the same length.

As such, the slider 44 may be movable along the respective slider lengths of the tension members 40, 42 in unison, i.e., occupying the same position along the respective first tension member 40 and second tension member 42 along the respective first slider length and second slider length thereof. In this way, the slider 44 is moveable along each of the first tension member 40 and the second tension member 42 between a first position 100 (FIGS. 1-3, 7A-7B, and 9A) and a second position 200 (FIGS. 4-6, 8A-8B, and 9B). Said another way, the slider 44 is moveable along each of the first tension member 40 and the second tension member 42 from the first position 100 to the second position 200.

In each example embodiment, the slider 44 is moveable along the first tension member and the second tension member 42 between the first position 100 and the second position 200 via a pull feature 88. The pull feature 88 is operatively connected to the slider 44. The pull feature 88 may be formed from a textile, leather, polymeric, or similar material and may further be defined as a strip of material or a loop of material operatively attached to the slider 44. In this way, the user may exert force upon the pull feature 88 in the desired direction to move the slider 44 between the first position 100 and the second position 200.

As shown in FIGS. 1-3, 7A-7B, and 9A, in the first position 100 the slider 44 is closer to the vamp 46 than the ankle opening 15. As such, in the first position 100, the ankle opening 15 is larger, i.e., a maximum size of the ankle opening 15 is larger or increased to allow ease of access for insertion of a foot into the interior volume 16. Said another way, in the first position 100, the article of footwear 10 is not fastened about a foot present within the interior volume 16.

As shown in FIGS. 4-6, 8A-8B, and 9B, in the second position 200 the slider 44 is closer to the ankle opening 15 than the vamp 46. As such, in the second position 200, the ankle opening 15 is smaller, i.e., a maximum size of the ankle opening 15 is smaller or reduced so as to secure a foot of a wearer within the interior volume 16. Said another way, in the second position 200, the article of footwear 10 is fastened about a foot present within the interior volume 16.

Accordingly, as shown in FIGS. 1-9B, moving the slider 44 along the first tension member 40 and the second tension member 42, from the first position 100 to the second position 200 operatively reduces a maximum size of the ankle opening 15. Said another way, moving the slider 44 along the first tension member 40 and the second tension member 42, from the second position 200 to the first position 100 operatively enlarges or increases the maximum size of the ankle opening 15.

In a tension fit application, wherein the upper 12 is pulled against a foot present within the interior volume 16 at all times including on a lower side where the sole of the foot contacts a bottom portion of the upper 12, moving the slider 44 from the first position 100 to the second position 200 imparts tension in each of the lateral sidewall portion 24 and the medial sidewall portion 26, when a foot is within the interior volume 16, such that the upper 12 may simply fit the foot very snugly without significant expansion. Said another way, moving the slider 44 from the second position 200 to the first position 100 releases tension in each of the lateral sidewall portion 24 and the medial sidewall portion 26, such that a foot may be comfortably or easily inserted or removed from within the interior volume 16.

In some examples, movement of the slider 44 between the first position 100 and the second position 200 may further operatively adjust a maximum distance across the throat opening 28 from the lateral sidewall portion 24 to the medial sidewall portion 26. For example, as shown in FIGS. 1-6 and 9A-9B, when a foot occupies the interior volume 16, a maximum distance D1 across the throat opening 28 from the lateral sidewall portion 24 to the medial sidewall portion 26 is greater when the slider 44 occupies the first position 100 (FIGS. 1-3, 7A-7B, and 9A) than the maximum distance D2 across the throat opening 28 from the lateral sidewall portion 24 to the medial sidewall portion 26, when the slider 44 occupies the second position 200 (FIGS. 4-6, 8A-8B, and 9B). As such, when a foot occupies the interior volume 16, moving the slider 44 from the second position 200 to the first position 100 increases the maximum distance from the lateral sidewall portion 24 to the medial sidewall portion 26 at the throat opening 28 from the maximum distance D2 (FIGS. 4-6, 8A-8B, and 9B) to the maximum distance D1 (FIGS. 1-3, 7A-7B, and 9A), and moving the slider 44 from the first position 100 to the second position 200 decreases the maximum distance from the lateral sidewall portion 24 to the medial sidewall portion 26 at the throat opening 28 from the maximum distance D2 (FIGS. 4-6, 8A-8B and 9B) to the maximum distance D1 (FIGS. 1-3, 7A-7B, and 9A).

As shown in FIGS. 9A and 9B, in example embodiments wherein the slider 44 is coupled to the tongue body 56, moving the slider 44 from the second position 200 to the first position 100, causes the tongue body 56 to be drawn forward to further promote ease of access for insertion of a foot into the interior volume 16. When the slider 44 occupies the first position 100, the tongue distal edge 58 is closer to the vamp 46 than when the slider 44 occupies the second position 200, and when the slider 44 occupies the second position 200 the tongue distal edge 58 is farther from the vamp 46 than in the first position 100. When the slider 44 occupies the first position 100, the tongue distal edge 58 is farther from the ankle opening 15 than when the slider 44 occupies the second position 200, and when the slider 44 occupies the second position 200 the tongue distal edge 58 is closer to the ankle opening 15 than in the first position 100. Said another way, the tongue distal edge 58 is positioned above the throat opening 28 and substantially between the lateral sidewall portion 24 and the medial sidewall portion 26, when the slider 44 occupies the first position 100, and the tongue distal edge 58 is positioned below the throat opening 28 and substantially between the lateral sidewall portion 24 and the medial sidewall portion 26, when the slider 44 occupies the second position 200.

In example embodiments, wherein the slider 44 is coupled to the tongue body 56, one or more elastic gores 84, may extend between the tongue body 56 and an edge of the sole structure 14, an edge of the insole, and/or an edge of a strobel. These elastic gores 84 may be operative to return the tongue body 56 and the tongue distal edge 58 within the throat opening 28 beneath the lateral sidewall portion 24 and the medial sidewall portion 26, when the slider 44 is moved from the first position 100 to the second position 200. In one example, the design may include a first elastic gore 84 provided adjacent and interior to the lateral sidewall portion 24, and a second elastic gore 84 provided adjacent and interior to the medial sidewall portion 26. The gores 84 may cooperate to elastically re-set the tongue body 56 after a foot has been placed within the interior volume 16, and the slider 44 is moved from the first position 100 to the second position 200.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Benefits, other advantages, and solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

What is claimed is:

1. An article of footwear comprising:

a sole structure;

an upper fixedly attached to the sole structure at a bite line disposed between the upper and the sole structure, the upper having a forefoot region, a midfoot region, and a heel region, and the upper comprising:

a vamp, a lateral sidewall portion, and a medial sidewall portion, the lateral sidewall portion and the medial sidewall portion cooperating to define an interior volume therebetween with the vamp at least partially forward of the lateral sidewall portion and the medial sidewall portion in the forefoot region;

an ankle opening operative to allow a user to extend a foot into the interior volume;

a throat opening extending from the ankle opening to the forefoot region and between the lateral sidewall portion and the medial sidewall portion;

a closure mechanism comprising:

a first tension member coupled to the lateral sidewall portion and extending along a length of the throat opening, the first tension member having a first tension member first end coupled to the lateral sidewall portion at a first lateral attachment point positioned at the vamp, a first tension member intermediate point coupled to the lateral sidewall portion at a second lateral attachment point positioned at the ankle opening, and a first tension member second end coupled to the upper at a third lateral attachment point at the bite line; wherein the first tension member extends exterior to the upper along the throat opening from the first tension member first end, then extends under an edge of the lateral sidewall portion at the throat opening to an inner side of the lateral sidewall portion, and then extends through the lateral sidewall portion from the inner side of the lateral sidewall portion to an exterior side of the lateral sidewall portion before the first tension member intermediate point, and then extends through the lateral sidewall portion from the exterior side of the lateral sidewall portion to the inner side of the lateral sidewall portion and downward and rearward along the inner side of the lateral sidewall portion to the third lateral attachment point; wherein the edge of the lateral sidewall portion extends along and defines the throat opening;

a second tension member attached to the medial sidewall portion and extending along the length of the throat opening, the second tension member having a second tension member first end coupled to the medial sidewall portion at a first medial attachment point positioned at the vamp, a second tension member intermediate point coupled to the medial sidewall portion at a second medial attachment point positioned at the ankle opening, and a second tension member second end coupled to the upper at a third medial attachment point at the bite line; wherein the second tension member extends exterior to the upper along the throat opening from the second tension member first end, then extends under an edge of the medial sidewall portion at the throat opening to an inner side of the medial sidewall portion, and then extends through the medial sidewall portion from the inner side of the medial sidewall portion to an exterior side of the medial sidewall portion before the second tension member intermediate point, and then extends through the medial sidewall portion from the exterior side of the medial sidewall portion to the inner side of the medial sidewall portion and downward and rearward along the inner side of the medial sidewall portion to the third medial attachment point; wherein the edge of the medial sidewall portion extends along and defines the throat opening;

a slider coupled to and moveable along each of the first tension member and the second tension member from a first position to a second position; and wherein in the first position the slider is closer to the vamp than the ankle opening, and in the second position the slider is closer to the ankle opening than the vamp, such that moving the slider from the first position to the second position imparts tension in each of the lateral sidewall portion and the medial sidewall portion and operatively reduces a maximum size of the ankle opening.

2. The article of footwear of claim 1 wherein a distance across the throat opening from where the second tension member extends under the edge of the lateral sidewall portion to where the first tension member extends under the edge of the medial sidewall portion is greater when the slider occupies the first position than when the slider occupies the second position.

3. The article of footwear of claim 2 wherein moving the slider from the first position to the second position decreases the distance across the throat opening from where the second tension member extends under the edge of the lateral sidewall portion to where the first tension member extends under the edge of the medial sidewall portion; and wherein moving the slider from the second position to the first position increases the distance across the throat opening from where the second tension member extends under the edge of the lateral sidewall portion to where the first tension member extends under the edge of the medial sidewall portion.

4. The article of footwear claim 1 further comprising a tongue, the tongue having a first tongue portion attached to the vamp and a tongue body extending from the first tongue portion under and interior to the throat opening and between the lateral sidewall portion and the medial sidewall portion; and wherein the tongue body is coupled to the slider.

5. The article of footwear of claim 4 wherein a tongue attachment feature extends from the tongue body; and wherein the tongue attachment feature is coupled to the slider.

6. The article of footwear of claim 5 wherein:

the tongue body defines a tongue distal edge;

wherein the tongue distal edge is closer to a rear of the ankle opening and further from where the first tension member extends under the edge of the lateral sidewall portion and where the second tension member extends under the edge of the medial sidewall portion when the slider occupies the second position than when the slider occupies the first position; and wherein the tongue distal edge is closer to the first lateral attachment point and the second lateral attachment point at the vamp when the slider occupies the first position than when the slider occupies the second position.

7. The article of footwear of claim 6 wherein the tongue distal edge is positioned below the throat opening and substantially between the lateral sidewall portion and the medial sidewall portion when the slider occupies the second position; and wherein the tongue distal edge is positioned above the throat opening and substantially between the lateral sidewall portion and the medial sidewall portion when the slider occupies the first position.

8. The article of footwear of claim 4 wherein:

the upper defines an insole;

a first elastic gore couples the tongue body to the insole and extends along and interior to the lateral sidewall portion; and a second elastic gore couples the tongue body to the insole and extends along and interior to the medial sidewall portion.

9. The article of footwear of claim 1 wherein:

the first tension member has a first slider length defined from the first tension member first end to the first tension member intermediate point;

the second tension member has a second slider length defined from the second tension member first end to the second tension member intermediate point; and the first slider length is equal to the second slider length, such that the slider is moveable along the first tension member within the first slider length and along the second tension member within the second slider length between the first position and the second position.

10. The article of footwear of claim 9 wherein:

the lateral sidewall portion and the medial sidewall portion are disposed on opposite sides of a longitudinal midline that bisects the upper; and the first tension member along the first slider length is non-intersecting with the second tension member along the second slider length.

11. The article of footwear of claim 10 wherein the first tension member comprises a non-elastomeric cord and the second tension member comprises the non-elastomeric cord.

12. The article of footwear of claim 11 wherein:

the lateral sidewall portion and the medial sidewall portion further define a heel counter portion;

the third lateral attachment point is positioned between the second lateral attachment point and the heel counter portion; and the third medial attachment point is positioned between the second medial attachment point and the heel counter portion.

13. The article of footwear of claim 10 wherein the first tension member comprises a non-elastomeric cord from the first tension member first end to the first tension member intermediate point and the second tension member comprises the non-elastomeric cord from the second tension member first end to the second tension member intermediate point.

14. The article of footwear of claim 13 wherein:

the lateral sidewall portion and the medial sidewall portion further define a heel counter portion;

the third lateral attachment point is positioned at the bite line proximate the heel counter portion, such that the first tension member second end is anchored to the upper at the bite line in the heel counter portion at the third lateral attachment point; and the third medial attachment point is positioned at the bite line proximate at the heel counter portion, such that the second tension member second end is anchored to the upper at the bite line in the heel counter portion at the third medial attachment point.

15. The article of footwear of claim 14 wherein the first tension member comprises the non-elastomeric cord from the first tension member intermediate point to the first tension member second end and the second tension member comprises the non-elastomeric cord from the second tension member intermediate point to the second tension member second end.

16. The article of footwear of claim 14 wherein:

the upper defines a predefined datum between the bite line and the ankle opening, such that the predefined datum is disposed below the ankle opening and above the bite line;

the first tension member comprises a first tension member first portion and a first tension member second portion, the first tension member first portion and the first tension member second portion being disposed between the first tension member intermediate point and the first tension member second end, wherein the first tension member first portion extends from the first tension member intermediate point to the predefined datum and the first tension member second portion extends from the predefined datum to the first tension member second end; and the second tension member comprises a second tension member first portion and a second tension member second portion, the second tension member first portion and the second tension member second portion being disposed between the second tension member intermediate point and the second tension member second end, wherein the second tension member first portion extends from the second tension member intermediate point to the predefined datum and the second tension member second portion extends from the predefined datum to the second tension member second end.

17. The article of footwear of claim 16 wherein the first tension member first portion comprises the non-elastomeric cord and the second tension member first portion comprises the non-elastomeric cord; and wherein the first tension member second portion comprises an elastomeric strap and the second tension member second portion comprises an elastomeric strap.

18. The article of footwear of claim 10 further comprising:

an ankle collar portion defined by the lateral sidewall portion and the medial sidewall portion, wherein the ankle collar portion is adjacent to and surrounds the ankle opening;

an eye stay reinforcement disposed about and adjacent to the throat opening and further disposed between the ankle collar portion and the vamp, the eye stay reinforcement further defining:

a first eyelet opening disposed at each of the first lateral attachment point positioned at the vamp on the lateral sidewall portion and the first medial attachment point positioned at the vamp on the medial sidewall portion, wherein the first eyelet opening disposed at the first lateral attachment point at the vamp receives the first tension member first end and couples the first tension member first end to the lateral sidewall portion at the first lateral attachment point, and wherein the first eyelet opening disposed at the first medial attachment point at the vamp receives the second tension member first end and couples the second tension member first end to the medial sidewall portion at the first medial attachment point; and a second eyelet opening disposed at each of the second lateral attachment point and the second medial attachment point positioned at the ankle collar portion and adjacent to the throat opening on each of the lateral sidewall portion and the medial sidewall portion, wherein the second eyelet opening is defined by the eye stay reinforcement and the lateral sidewall portion receives the first tension member and couples the first tension member to the lateral sidewall portion, and wherein the second eyelet opening defined by the eye stay reinforcement and the medial sidewall portion receives the second tension member and couples the second tension member to the medial sidewall portion.

19. The article of footwear of claim 18 wherein the eye stay reinforcement further defines:

a third eyelet opening disposed at each of the second lateral attachment point and the second medial attachment point positioned at the ankle collar portion on each of the lateral sidewall portion and the medial sidewall portion, wherein the first tension member extends through the lateral sidewall portion from the exterior side of the lateral sidewall portion to the inner side of the lateral sidewall portion at the third eyelet opening defined by the lateral sidewall portion such that the third eyelet opening defined by the lateral sidewall portion receives the first tension member and couples the first tension member to the lateral sidewall portion, and wherein the second tension member extends through the medial sidewall portion from the exterior side of the medial sidewall portion to the inner side of the medial sidewall portion at the third eyelet opening defined by the medial sidewall portion such that the third eyelet opening defined by the medial sidewall portion receives the second tension member and couples the second tension member to the medial sidewall portion;

wherein the second eyelet opening is disposed between the third eyelet opening and the throat opening on each of the lateral sidewall portion and the medial sidewall portion, and wherein the third eyelet opening is disposed between the second eyelet opening and the ankle opening on each of the lateral sidewall portion and the medial sidewall portion; and wherein the first tension member intermediate point is disposed between the second eyelet opening and the third eyelet opening on the lateral sidewall portion, and wherein the second tension member intermediate point is disposed between the second eyelet opening and the third eyelet opening on the medial sidewall portion.

* * * * *